US005276928A

United States Patent [19]

Smith

[11] Patent Number: 5,276,928

[45] Date of Patent: Jan. 11, 1994

[54] COMBINATION BOW HOIST AND ARROWHEAD WRENCH

[76] Inventor: Terry B. Smith, 1760 Hubert Rd., Midland, Mich. 48640

[21] Appl. No.: 8,296

[22] Filed: Jan. 25, 1993

[51] Int. Cl.[5] ..... B25F 1/00

[52] U.S. Cl. ..... 7/138; 7/170; 7/169

[58] Field of Search ..... 7/138, 170, 167, 169; 81/121.1, 176.1, 176.2

[56] References Cited

U.S. PATENT DOCUMENTS

| | | | |
|---|---|---|---|
| D. 120,489 | 5/1940 | Musselman | 81/121.1 |
| 4,351,075 | 9/1982 | Pittard, Jr. | 7/138 |
| 5,224,400 | 7/1993 | Maleski | 81/121.1 |

*Primary Examiner*—Roscoe V. Parker

*Attorney, Agent, or Firm*—Merlin B. Davey

[57] ABSTRACT

A combination bow hoist and arrowhead wrench comprising a flexible cord securely attached to a substantially rigid body having means to compactly and securely store the flexible cord, means for securely holding a bow for raising the bow to an elevated position and wrench means for attaching arrowheads to arrow shafts.

5 Claims, 1 Drawing Sheet

COMBINATION BOW HOIST AND ARROWHEAD WRENCH

BACKGROUND OF THE INVENTION

When hunting with a bow and arrow it is common practice for the hunter to establish himself on a perch or platform in a tree at some distance above the ground to widen the field of vision and make it less likely that deer or other game animals will detect his presence. The equipment employed in present day bow hunting can be quite heavy and cumbersome, and therefore it is often difficult to raise the bow and other assorted hunting needs to the desired height. It is, therefore, a desideratum of the art, to provide a simple, direct means for enabling the hunter to raise his bow and other equipment to his hunting platform, which means is, itself, easily transported to the desired region for use.

SUMMARY OF THE INVENTION

This invention provides a combination bow hoist and arrowhead wrench comprising a flexible cord securely attached to a substantially rigid body, said rigid body comprising means to compactly and securely store said flexible cord, means for securely holding a bow for raising said bow to an elevated position and wrench means for attaching arrowheads to arrow shafts.

DETAILED DESCRIPTION OF THE INVENTION

More particularly, this invention provides a combination bow hoist and arrowhead wrench having an elongated body having a first end and a second end, a first generally flattened surface opposed to a second generally flattened surface, said surfaces disposed between and connecting said first end and said second end, a first side or edge and an opposed second side or edge and a flexible cord attached near said first end and wherein said attachment is offset nearer said first side than said second side and means for releasably holding said bow positioned near said second end on said first side.

In one embodiment of this invention the means for holding said bow comprise a substantially rigid arm extending outwardly from said first side and near said second end and toward said first end at an angle of up to about 90° from said first side, said arm terminating in a lobe extending toward said first end, said lobe portion including an arrowhead wrench.

The substantially rigid arm extends toward said first end outwardly away from said body at an angle of, preferably 80° to 90°.

In a preferred embodiment, this invention provides a combination bow hoist and arrowhead wrench comprising an elongated essentially rigid body adapted to stow or store a flexible cord, said body having a first end and a second end, a first generally flattened surface opposed to a second generally flattened surface, said surfaces disposed between and connecting said first end and said second end, a first side and a second side, said first and second sides disposed between and connecting said first and second surfaces, each of said ends having a notch therein, said hoist having means for attaching said flexible cord near said first end and an arm extending outwardly at an angle of 90° or less from said first side near said second end, said arm terminating in an arrowhead wrench defining a generally circular passage extending through said arm and further having at least six slots radially extending from said passage, four of said slots being at right angles to each other and two other of said slots being at an angle of 120° with one of said four slots, the notches of said first and second ends being adapted to engage said flexible cord when it is wound up on said bow hoist, said second side having a groove or slot therein adapted to engage said flexible cord and hold said cord in a fixed, releasable position.

Figure 1:
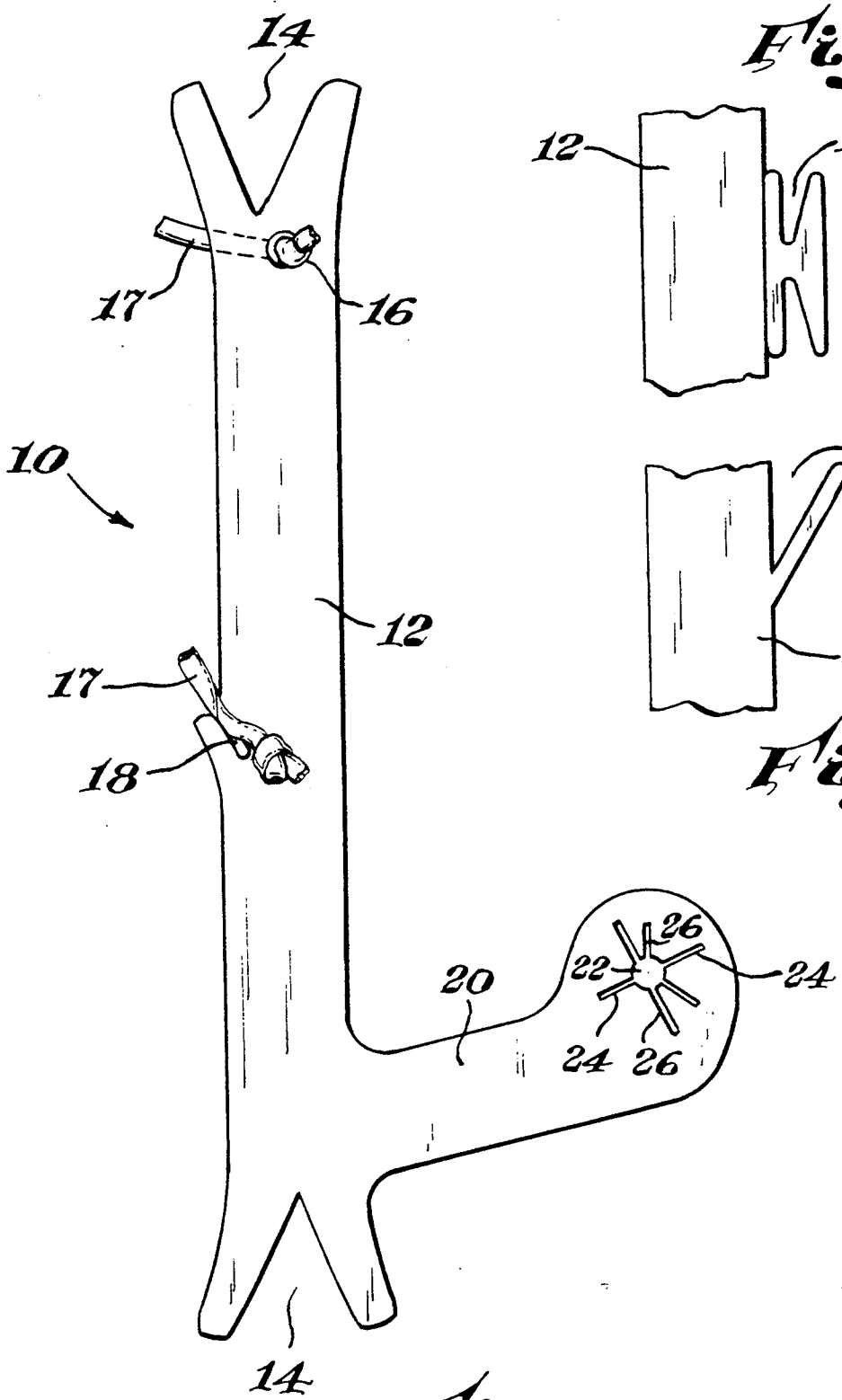
Figure 2:
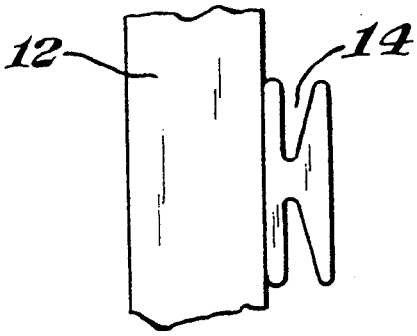
Figure 3:
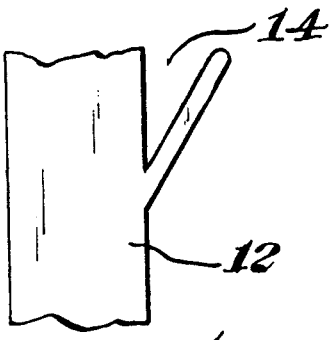

The present invention is further illustrated by the accompanying drawing wherein FIG. 1 is a view of one embodiment of the combination bow hoist and arrowhead wrench of this invention and FIGS. 2 and 3 illustrate alternative means for stowing a flexible cord.

In FIG. 1, 10 is a combination bow hoist and arrowhead wrench made of an elongated essentially rigid body 12 having notches 14 in both ends thereof, a hole or passageway 16 near one end, a groove 18 on one side and an arm 20 on the other side and near the second end. Hole or passageway 16 is offset from the center of rigid body 12 toward the side from which arm 20 extends thereby compensating for the weight of a bow or other material to be hoisted into a tree stand. Arm 20 further includes a passage 22, and slots 24 and 26 radiating from said passage 22, slots 24 are set at right angles to each other and slots 26 are set at an angle of 120° with one of slots 24.

V-shaped notches 14 are of sufficient depth and width to hold sufficient and desired turns of cord for ready storage and easy release. Alternatively, one or more pegs may be positioned on said first side at an acute angle for winding up and storing said cord or, if desired, a cleat such as a deck or mooring cleat may be employed as illustrated in FIGS. 2 and 3.

Arm 20 serves both for attachment of a bow, or other equipment that it is desired to hoist into a tree, and as an arrowhead wrench. Slots 24 and 26 and passageway 22 are adapted to engage the modular or fixed blade broadhead arrow tips that utilize a threaded means for attaching to arrows.

Arm 20 is extended outwardly at an angle of 90° or slightly less for about two inches and is adapted to engage and support recurves and all late technology compound bows.

Body 12 of hoist 20 may be made of any rigid or semi-rigid phenolic, polyurethane, hard rubber, epoxy impregnated fiber glass cloth, wood or metal but is preferably made of a semi-rigid polyurethane or similar sound deadening plastics material. The dimensions of body 12 are such that the hoist of this invention easily fits into a jacket or pants pocket and thus does not contribute to the problems of transporting hunting gear and equipment into a tree. As will be apparent to those skilled in the art, body 12 may be readily adapted to include, if desired, a whetstone, compass, reflective tape, a hook to support bow cord for lifting, storage for waterproof matches, etc.

As already mentioned, a flexible cord 17, such as, for example, a ⅛" to 3/16" diameter nylon cord of 15 to 20 feet or so in length, may be used to pull the hoist and bow or other gear equipment into the tree stand or platform. Such cord is easily stored directly on the hoist by, for example, winding up on body 12 using notches 14, then inserting the cord through slot or passageway 18, which is of a width such that cord 17 is compressed and securely but releasably held, and knotting.

As is apparent, the hoist and wrench mechanism of this invention gives the hunter the ability for field installation of arrowheads without taking anything extra with him. The method of attaching and storing the flexible cord is such that the hunter in the tree can simply release the cord from slot 18 and allow the bow hoist to drop to near ground level where it will be automatically positioned for loading the bow or other equipment to be raised into the tree.

Further, the hunter does not have to burden himself with other equipment while he is climbing into a tree or up to a loft. Still further, it is noted that it is not necessary to employ any knots or other fastening means to attach equipment to the hoist of this invention or to untie equipment in the tree, a distinct advantage in cold weather when wearing gloves or before daylight or after dark in the evening.

While the invention has been described with reference to a generally flat form as shown in FIG. 1, it is clear that other shapes or forms such as, for example, oval, circular, or I-beam shape may be employed, if desired.

Similarly, the storage of flexible cord 17 may be accomplished by attaching one or more mooring cleats to a side or edge of body 12 (FIG. 2), or, if desired, one or more side arms may be extended from body 12 at an acute angle (FIG. 3) and the flexible cord may be stored on said arm or arms. Further, arm 20 may be employed for stowing purposes by cutting a groove in the edge of arm 20 facing the second end of body 12.

Various modifications may be made in the present invention without departing from the spirit or scope thereof as will be readily apparent to those skilled in the art.

I claim:

1. A combination bow hoist and arrowhead wrench comprising a flexible cord securely attached to a substantially rigid body, said rigid body comprising means to compactly and securely store said flexible cord, means for securely holding a bow for raising said bow to an elevated position and wrench means for attaching arrowheads to arrow shafts.

2. Hoist of claim 1 wherein said body is an elongated body having a first end and a second end, a first generally flattened surface opposed to a second generally flattened surface, said surface disposed between and connecting said first and second ends, a first side and an opposed second side and said flexible cord is attached near said first end and said attachment is offset toward said first side and said means for holding said bow is positioned near said second end on said first side.

3. Hoist of claim 2 wherein said means for holding said bow comprise a substantially rigid arm extending outwardly from said first side and toward said first end at an angle of up to about 90° from said first side, said arm terminating in a lobe extending toward said first end, said lobe portion including an arrowhead wrench.

4. Hoist of claim 3 wherein said angle is from about 80° to about 90°.

5. A combination bow hoist and arrowhead wrench comprising a flexible cord and an elongated essentially rigid body having a first end and a second end, and a first side and a second side, each of said ends having a notch therein, said hoist having means for attaching said flexible cord near said first end and an arm extending outwardly at an angle of 80° to 90° from said first side near said second end, said arm terminating in an arrowhead wrench comprising a generally circular passage extending through said arm and further having at least six slots radially extending from said passage, four of said slots being at right angles to each other and two other slots being at an angle of 120° with one of said four slots, the notches of said first and second ends being adapted to engage said flexible cord when it is wound up on said bow hoist, said second side having a groove therein adapted to engage said flexible cord and hold said cord in a fixed, releasable position.

* * * * *